United States Patent [19]

Iizumi

[11] 4,175,473

[45] Nov. 27, 1979

[54] FLUID CIRCUIT

[75] Inventor: Tomomitsu Iizumi, Tokyo, Japan

[73] Assignee: Shoketsu Kinzoku Kogyo Kabushiki Kaisha, Tokyo, Japan

[21] Appl. No.: 785,206

[22] Filed: Apr. 6, 1977

[30] Foreign Application Priority Data

| | | | |
|---|---|---|---|
| Jun. 8, 1976 | [JP] | Japan | 51-73232[U] |
| Oct. 27, 1976 | [JP] | Japan | 51-143497[U] |
| Oct. 27, 1976 | [JP] | Japan | 51-144309[U] |

[51] Int. Cl.[2] ..... F15B 13/042; F15B 11/04

[52] U.S. Cl. ..... 91/443; 91/447

[58] Field of Search ..... 91/443, 447; 137/493, 137/493.7, 493.8, 493.9, 599

[56] References Cited

U.S. PATENT DOCUMENTS

| | | | |
|---|---|---|---|
| Re. 29,292 | 7/1977 | Tennis | 91/447 X |
| 840,876 | 1/1907 | Steedman | 91/443 |
| 2,272,684 | 2/1942 | Vickers | 91/447 X |
| 2,501,483 | 3/1950 | Taylor | 91/443 |
| 2,570,937 | 10/1951 | Gash | 137/493.8 |
| 3,213,886 | 10/1965 | Pearne | 91/443 X |

FOREIGN PATENT DOCUMENTS

| | | | |
|---|---|---|---|
| 1224196 | 2/1960 | France | 91/443 |

*Primary Examiner*—Robert G. Nilson

*Attorney, Agent, or Firm*—Toren, McGeady and Stanger

[57] ABSTRACT

A fluid circuit including an actuator, a flow-direction change-over valve and a pressure source. The actuator includes a piston-rod-side chamber and a piston-head-side chamber which are partitioned by a piston. In a fluid path leading from the piston-head-side chamber to the flow-direction change-over valve, there is provided a flow-rate-control, pressure-regulating valve assembly for regulating a fluid pressure to be fed into the piston-head chamber, thereby saving energy required for a return stroke of a piston. In another fluid path leading from the piston-head-side chamber to the flow-direction change-over valve, there is provided a check valve and throttle valve assembly. The check valve in the valve assembly may be of a type which allows the flow of a fluid only in the direction towards the piston-head-side chamber (a meter-in control) or may be of a type which allows the flow of a fluid only in the direction from the piston-head-side chamber (meter-out control). For accelerating an advancing stroke of a piston in the meter-in control type actuator at a safe speed, a speed control safety valve and a quick discharge valve assembly is incorporated in the fluid path leading to the cylinder-head-side chamber in the actuator in place of the aforesaid check valve and a throttle valve assembly.

1 Claim, 9 Drawing Figures

FLUID CIRCUIT

BACKGROUND OF THE INVENTION

1. Field of the Invention

This invention relates to a fluid circuit, and more particularly to a fluid circuit including an actuator, in which the pressure of a fluid for effecting a return stroke of a piston in the actuator is regulated for the purpose of saving required for the return stroke of the piston.

2. Description of the Prior Art

It has been a common practice to apply a fluid pressure to a cylinder of an actuator to displace a piston, so that the movement of a piston rod connected to the piston may be taken out as a work. In this respect, a work carried out by the actuator depends on a fluid pressure acting on the side of a piston in a piston-head-side chamber. On the other hand, a pressure required for a return stroke of a piston (a pressure acting on the side of a piston in a piston-rod-side chamber) should not necessarily be as high as that required for the advancing stroke of a piston and thus may be reduced to the possible lowest level. Conventionally, however, it has been a practice that after the pressure regulation, a fluid pressure of the same level is applied to a piston-head side chamber as well as to a piston-rod side chamber, with the direction of a pressure fluid being switched by means of a flow-direction change-over valve. In other words, an excessive fluid pressure is used for the return stroke of a piston in the actuator.

Meanwhile, the speed control of a piston reciprocating within a cylinder of an actuator is classified into two types, i.e., a meter-out control type and a meter-in control type. In meter-out control type, when checking an actuator after completion of a work, a pressure within a cylinder of the actuator remains at an atmospheric pressure, so that the speed control of a piston is only possible when a pressure is being applied. Thus, in the other cases, the speed control of a piston becomes impossible, so that there often takes place a damage of a fixture or an accident of an operator. For this reason, an operator should pay excessive attension at the beginning of a work, thus lowering an operational efficiency. Accordingly, the meter-in control finds a wide application in this phase of industry. However, the meter-in control type suffers from disadvantages in that a pressure build-up time in a cylinder depends on the flow rate of a fluid being fed into the cylinder, and hence there results a slow return stroke of a piston which leads to a lowered operational efficiency.

SUMMARY OF THE INVENTION

It is accordingly an object of the present invention to provide a fluid circuit including an actuator, in which a fluid pressure required for effecting the return stroke of a piston is regulated to the possible lowest level, thereby saving energy required for the return stroke of the piston.

It is another object of the present invention to provide a fluid circuit including an actuator of a meter-in control type, in which the return movement of a piston may be accelerated at a safe speed.

It is still another object of the present invention to provide a fluid circuit including an actuator either of a meter-in or a meter-out control type, in which a fluid pressure required for effecting a return stroke of a piston may be regulated to the possible lowest level, thereby saving energy required for the return stroke of the piston.

According to the present invention, there is provided a fluid circuit including: an actuator, a flow-direction change-over valve and a pressure source, in which a flow-rate-control, pressure-regulating valve assembly is incorporated in a fluid path leading from a piston-rod side chamber in the actuator to the flow-direction change-over valve therebetween, and in which a check valve of a meter-in control type or a meter-out control type and a throttle valve assembly is incorporated in another fluid path leading from a piston-head-side chamber in the actuator to the flow-direction change-over valve therebetween. In this respect, the flow-direction change-over valve is connected to a pressure source.

According to another aspect of the present invention, a speed-control-safety-valve, quick-discharge-valve assembly is incorporated in the aforesaid another fluid path for accelerating the return stroke of a piston in a cylinder of the actuator at a safe speed.

DESCRIPTION OF THE PREFERRED EMBODIMENTS

Description will be given of the first embodiment of the present invention, in which there is shown a fluid circuit including a meter-out control type actuator.

Figure 1:
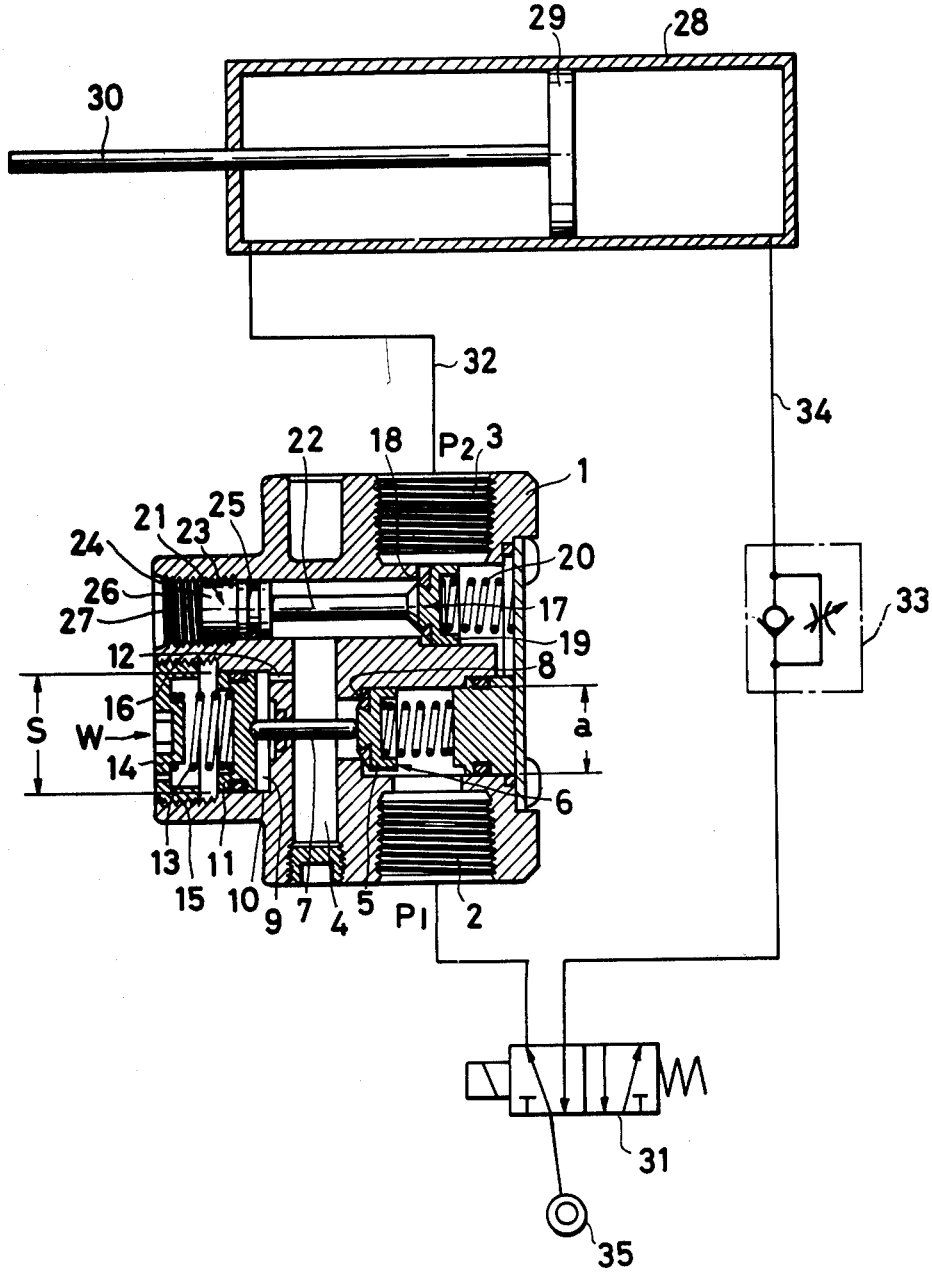
FIG. 1 is a view of a fluid circuit including an actuator of a meter-out control type according to the present invention, with a flow-rate-control, pressure-regulating valve assembly and the actuator being shown in cross section.

Referring to FIG. 1 shown at 1 is a body of a flow-rate-control, pressure-regulating valve assembly which is equipped with an inlet 2 and an outlet 3. Pressures prevailing in the inlet 2 and the outlet 3 are designated P1 and P2, respectively. A fluid passage 4 leads from the inlet 2 to the outlet 3, while a valve body 5 of a pressure regulating valve 6 is adapted to close the fluid passage in cooperation with a valve seat 8. The valve body 5 is urged under the action of a spring in the direction to abut the valve seat 8. The valve seat 8 has an opening of an area a. Provided in abutment with the end surface of the valve body 5 is a rod 7 which extends from a cylinder chamber 9 and engages a piston 11 slidable within the cylindrical surface 10. Interposed between the back surface of the piston 11 and a pressure adjusting handle 14 threaded into a threaded portion 15 defined in the wall of a casing of the valve assembly, is a pressure adjusting spring 13. A communicating hole 12 is provided so as to communicate the cylinder chamber 9 with the fluid passage 4. Meanwhile, there is normally provided a clearance between the valve body 5 and the valve seat 8 so as to allow a predetermined rate of flow of a fluid therethrough. A force W of the pressure adjusting spring 13, which acts on the valve body 5 through the medium of the piston 11 and rod 7, may be adjusted by rotating the aforesaid pressure adjusting handle 14 having a threaded portion 16 mated with the threaded portion 15. Included in the valve assembly is a flow rate control valve 17 which is adapted to control the opening of the valve 17.

The valve 17 is positioned on the side of the outlet 3, and includes a valve body 19 adapted to seat on a valve seat 18, and a valve stem 22, one end of which abuts the valve body 19 and the other end of which is continuous with an adjusting portion 21. The adjusting portion 21 is formed with a threaded cylindrical portion 24 adapted to be threaded into an internally threaded portion 23 provided in the wall of the body 1 of the valve assembly. An O-ring 25 is fitted on the adjusting portion 21, thereby sealing the fluid passage 4 in an air tight manner. The threaded portion 24 is formed with an end portion 26 exposed from the body 1, while the end portion 26 is formed with a slot 27 adapted to receive the tip of a screwdriver. Thus, by rotating the slot 27 by a screwdriver, the stem 22 may be displaced so as to move the valve body 19, thereby adjusting a clearance between the valve body 19 and the valve seat 18.

Meanwhile, the relationship between the pressure P1 (the primary side) and the pressure P2 (secondary side) is given as follows:

$$P2=(W-P1\times a)/(S-a)$$

Assume that the primary side pressure P1 is constant, then the area S of the piston 11 and an opening area a of the pressure regulating valve 6 are maintained constant, and hence the secondary side pressure P2 will be proportional to the force W of the pressure adjusting spring 13. Accordingly, there may be obtained a secondary side pressure P2 of a level proportional to the force of the pressure adjusting spring 13.

Figure 2:
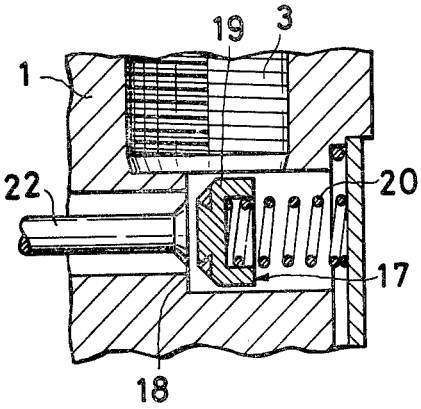
FIGS. 2 and 3 are cross-sectional view showing the operation of the flow rate control valve of FIG. 1.
Figure 3:
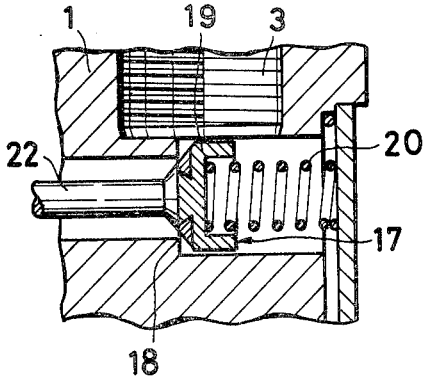

The flow-rate-control, pressure-regulating valve assembly is connected to a cylinder 28 of an actuator. The interior of the cylinder 28 is divided into two chamber by a piston 29 fitted therein, i.e., a rod-side chamber and head-side chamber. A fluid path 32 leads from the rod-side chamber in the cylinder 28 via the flow-rate-control, pressure-regulating valve assembly to a flow-direction change-over valve 31. A pressure source 35 is connected to the aforesaid flow-direction change-over valve 31. Another fluid path 34 leads from the head-side chamber in the cylinder 28 via a check-valve-throttle-valve assembly 33 to the flow-direction-change-over valve 31. In this respect, the movement of the piston 29 which is slidingly displaced within the cylinder 28 is taken out through the medium of the rod 30 as work. In this case, there is established a meter-out circuit which includes the fluid path 32 leading from the pressure source 35 via the flow-direction change-over valve 31 and flow-rate-control, pressure-regulating valve assembly to the rod-side chamber, and another fluid path 34 leading from the pressure source via the flow-direction change-over valve 31 and check-valve-throttle-valve assembly 33 to the head-side chamber in the cylinder 28. Thus, a pressure acting on the rod-side chamber in the cylinder from the pressure source 35 so as to return the piston 29 may be reduced to a minimized level by means of the pressure adjusting spring 13. When a given level of pressure is applied through the fluid path 34 to the head-side chamber in the cylinder 28, a fluid in the rod-side chamber is returned through the fluid path 32 i.e., the flow-rate-control valve 17 to the pressure source 35. The detailed operation of the flow-rate-control valve 17 is shown in FIGS. 2 and 3, in which FIG. 2 refers to a pressure supplying mode for the rod-side chamber in the cylinder 28, and FIG. 3 refers to a pressure discharge mode for the rod-side chamber in the cylinder 28, showing the positional relationship between the valve body 19 and the valve seat 18.

Meanwhile, the check valve included in the valve assembly 33 allows the flow of a fluid only in the direction towards the head-side chamber in the cylinder 28. On the return stroke of a piston 29, when a pressure of a level exceeding a given pressure level is applied to the pressure regulating valve 6, then a pressure is applied through the passage 12 to the piston 11 so as to move the piston 11 backwards so that the rod 7 is also moved back, thereby the valve body 5 may abut the valve seat 8, closing the fluid passage 4. On the other hand, on the advancing stroke of the piston, fluid is discharged from the rod-side chamber via a clearance between the valve body 19 and the valve seat 18, and then a clearance between the valve body 5 and the valve seat 8 into the inlet 2. Thus, a pressure required for returning the piston 29 may be reduced to a desired level, thus saving energy required for a return stroke of the piston 29.

Description will be given of the second embodiment of the present invention, in which there is provided a fluid circuit including an actuator of a meter-in control type.

Figure 4:
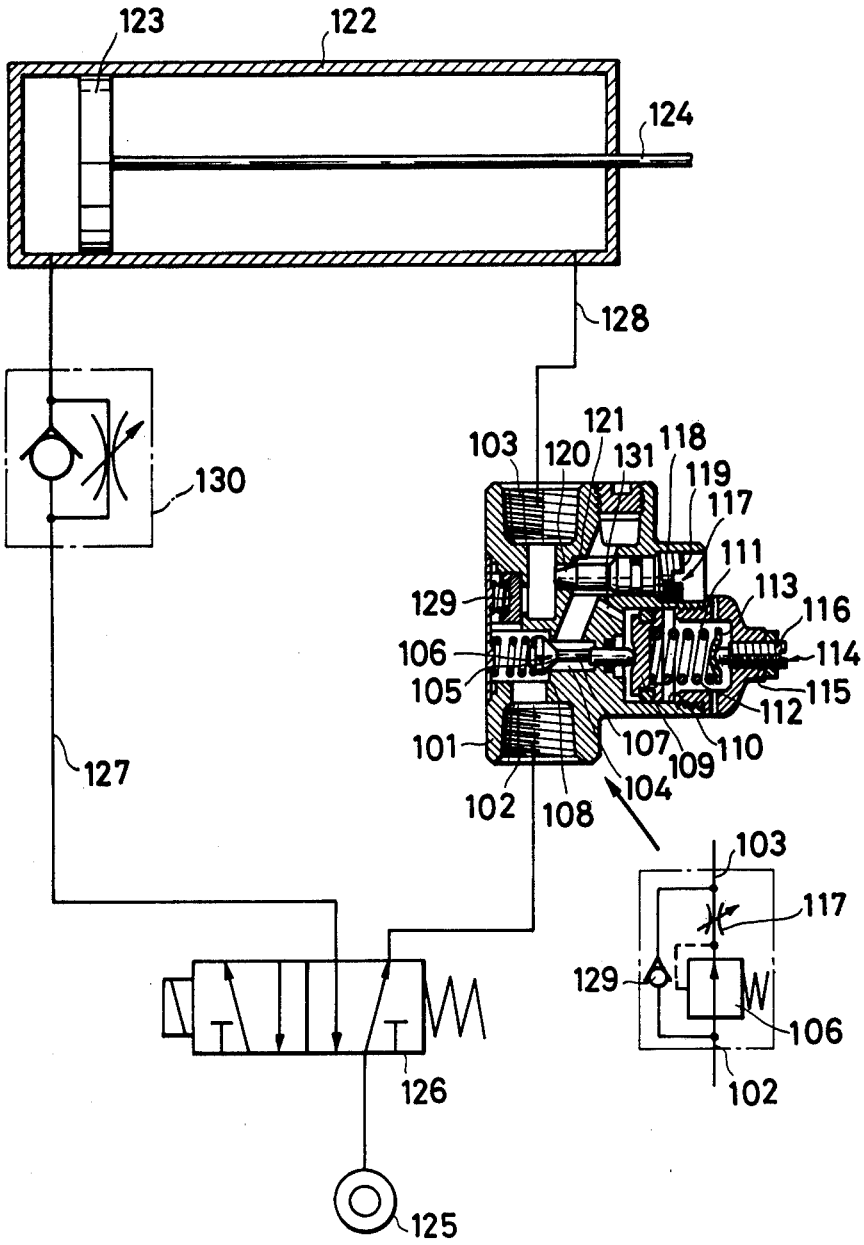
FIG. 4 is a view of a fluid circuit including an actuator of a meter-in control type according to the present invention, with a flow-rate-control, pressure-regulating valve assembly shown in cross section.

Referring to FIG. 4, shown at 101 is a body of a flow-rate-control, pressure-regulating valve assembly according to the present invention. The body 101 is provided with an inlet 102 and an outlet 103, which are communicated with each other through a passage 104. In the pressure-regulating valve 106, there is provided a rod 107 secured to a valve body 105 which is adapted to close the passage 104 in cooperation with a valve seat 108. The rod 107 extends across the passage 104 and abuts a piston 109 which is adapted to slidingly move along a wall 110 of a chamber 111. Shown at 131 is a passage communicating the chamber 111 with a flow path leading from the inlet 102 to the outlet 103. A pressure adjusting spring 112 is confined between the back surface of the piston 109 and a pressure adjusting screw 114, with a pressure adjusting spring guide 113 interposed therebetween. The screw 114 having a threaded portion 116 is threaded into a threaded hole 115 defined in the wall of the body 101. Thus, a force of the pressure-adjusting spring 112 which acts on the valve body 105 through the piston and rod 107, may be adjusted by rotating the aforesaid pressure adjusting screw 114. A flow rate regulating valve 117 is provided on the side close to the output 103 so as to adjust a clearance between the valve body 120 and a valve seat 121 cooperative therewith. The flow-rate regulating valve 117 is formed with a threaded portion 119 adapted to be threaded into a threaded hole 118 defined in the wall of the body 101. Thus, the valve body 120 may be moved towards or away from the valve seat 121 due to the rotation of the threaded portion 119, thereby controlling the flow rate of a fluid flowing through a clearance defined therebetween.

The flow-rate-control, pressure-regulating valve assembly according to the present invention is connected to a rod-side chamber in a cylinder 122 of an actuator. A piston 123 is fitted in the cylinder 122 and the movement of a rod 124 secured to the piston 123 is taken out as a work. In this embodiment, there is established a meter-in circuit including a fluid path 128 leading from the rod-side chamber in the cylinder 122, via the flow-rate-control, pressure-regulating valve assembly (117, 106) and then through a flow-direction change-over valve 126, to a pressure source, and another fluid path 127 leading from a head-side chamber in the cylinder 122 via a check-valve-throttle-valve assembly 130 and flow-direction change-over valve 126 to the pressure source 125. In this respect, the check valve included in the valve assembly 130 allows the flow of a fluid only in the direction from the head-side chamber to the flow-direction change-over valve 126. On a return stroke of the piston, a pressure is applied from the pressure source 125 through the flow-direction change-over valve 126 and the flow-rate-control, pressure-regulating valve assembly to a rod-side chamber in the cylinder 122, so that the aforesaid pressure may be reduced to a desired level by means of the pressure adjusting spring 112. On an advancing stroke of the piston 123, a pressure is supplied from the pressure source 125 via the flow-direction change-over valve 126 and the check-valve-throttle-valve 130 to the head-side chamber in the cylinder 122. In this case, a fluid is returned from a rod-side chamber in the cylinder via a check valve 129, and then via the inlet 102, and then via the flow direction change-over valve 126 to the pressure source 125. In this embodiment as well, when a pressure of a level exceeding a given level is applied to the pressure regulating valve 106, the pressure acts on the piston 109 through a passage 131 so as to force the piston 109 backwards, so that the rod 107 may move back, with the result that the valve body 105 closes the passage 104 in cooperation with the valve seat 106.

In this case, the air consumption on a return stroke of the piston 123 in the cylinder 122 is given in a table below, in terms of the consumption 100% of air on an advancing stroke of the piston 123.

| Line pressure / Set pressure | 5 kg/cm$^2$ | 6 kg/cm$^2$ | 7 kg/cm$^2$ |
|---|---|---|---|
| 1 kg/cm$^2$ | 69% | 66% | 65% |
| 2 kg/cm$^2$ | 76% | 73% | 70% |
| 3 kg/cm$^2$ | 84% | 80% | 76% |

Description will be turned to the third embodiment of the present invention, which provides a flow-rate-control, pressure-regulating valve assembly which is employable for the first and second embodiments of the present invention.

Figure 5:
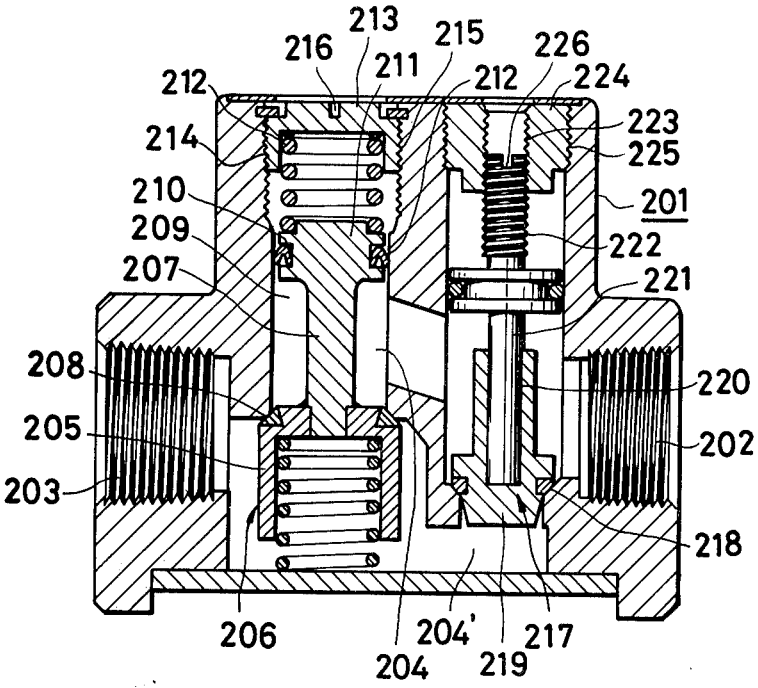
FIG. 5 is a cross-sectional view of a flow-rate-control, pressure-regulating valve assembly which may be employed for fluid circuits including a meter-in or a meter-out control type actuator according to the present invention.

Referring to FIG. 5, there is shown a flow-rate-control, pressure-regulating valve assembly according to the present invention, which may be applied to meter-in and meter-out fluid circuits in a manner described earlier.

Shown at 201 is a body of the flow-rate-control, pressure-regulating valve assembly according to the present invention. The body 201 is provided with an inlet 202 and an outlet 203. Passages 204 and 204' communicate the inlet 202 with the outlet 203 in the valve assembly. A pressure regulating valve 206 includes a valve body 205 adapted to close the passage 204 in cooperation with a valve seat 208. The valve body 205 is secured to one end of a rod 207, the other end of which is secured to a piston 211 adapted to slidingly move along an inner wall 210 of a cylindrical chamber 209. A pressure adjusting spring 212 is confined between the back surface of the piston 211 and a pressure adjusting member 213 which is exposed from the valve assembly externally. The pressure adjusting member 213 is formed with a threaded portion 215 adapted to be threaded into a threaded hole 214 defined in the wall of the body 201. In addition, the pressure adjusting member 213 is formed with a slot 216 at its outer end. The tip of a screwdriver is inserted into the slot 216 and turned so as to vary a force of the pressure adjusting spring 212 which acts on the back surface of the piston 211, and hence on the valve body 205 through the medium of the rod 207. The valve body 205 is urged by another spring in the direction to close the passage 204 in cooperation with the valve seat 208. Normally, however, there is maintained a clearance between the valve body 205 and the valve seat 208, because a force of the spring 212 is greater than that of a spring referred to as another spring above.

The passage 204' runs in parallel with the passage 204, leading from the inlet 202 to the outlet 203. Provided in the passage 204' on the side of the inlet 202 is a flow rate control valve 217. The flow rate control valve 217 includes a valve body 219, a valve seat 218 cooperative therewith, a stem 221 which is loosely fitted in a hole 220 in the valve body 219 on its one side. The other end portion of the stem 221 is threaded as at 222, and threaded into a threaded hole 223 defined in a threaded cylindrical portion 224, which in turn is threaded into the body 201. Provided in the end of the threaded portion 222 of the stem 221 is a slot 226 which is accessible from externally for adjustment of a position of the stem 221 and hence the position of the valve body 219 relative to the valve seat 218.

In operation, when a primary-side pressure is applied through the inlet 202 into the body 201, then a fluid may be directed through a clearance between the valve body 205 and the valve seat 208, as far as the pressure of a fluid is lower than a given set pressure level. When the pressure exceeds the aforesaid given set level, then the valve body 205 is forced against the valve seat 208, thereby closing the passage 204, due to a pressure acting on the piston 211.

When a fluid is directed from the outlet 203 to the inlet 202, then the fluid 206 bypasses the pressure regulating valve 206, but flows through a clearance defined between the valve body 219 and the valve seat 218 in the flow rate control valve 217, the aforesaid clearance being defined by an adjusted position of the stem 221.

Figure 6:
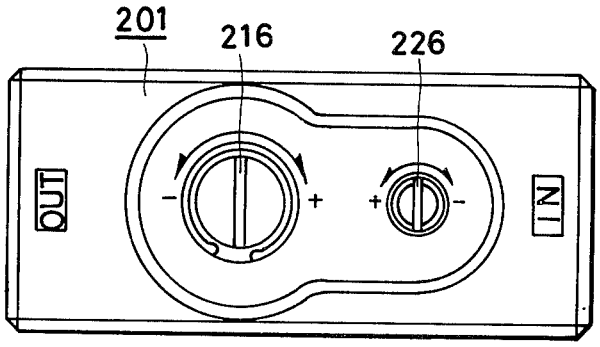
FIG. 6 is a plan view of the flow-rate-control, pressure-regulating valve of FIG. 5.

In this embodiment, by inserting and turning the tip of a screwdriver into the slots 216, 226, the flow rate and pressure adjustment may be readily achieved, as shown in FIG. 6.

Thus, on a return stroke of a piston in an actuator, a pressure to be applied to the rod-side chamber may be reduced to a desired level.

Description will be had for the fourth embodiment of the present invention, in which there is provided a fluid circuit including an actuator of a meter-in control type, and a speed-control-safety-valve and a quick-discharge-valve assembly which is incorporated in a fluid path leading from a head-side chamber to a flow-direction change-over valve for accelerating a return movement of a piston at a safe speed. In this case, as well, the flow-rate-control, pressure-regulating valve assembly is incorporated in another flow path leading from a rod-side chamber in the actuator to the flow-direction change-over valve therebetween.

Figure 7:
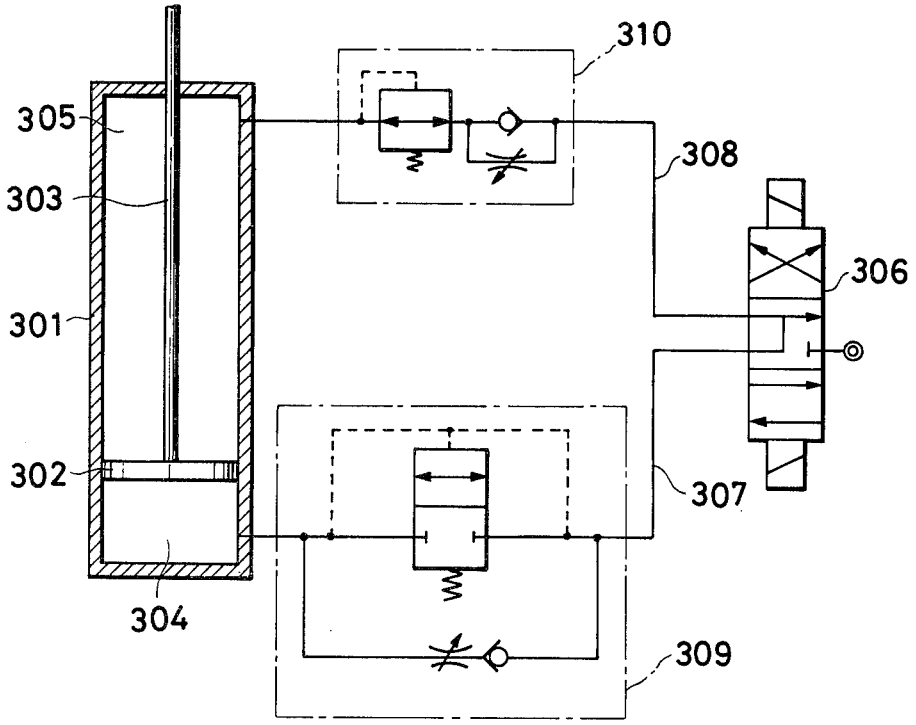
FIG. 7 is a diagram of a fluid circuit including a flow-rate-control, pressure-regulating valve assembly and a speed-control-safety-valve, quick-discharge-valve assembly according to the present invention.

Referring to FIG. 7, there is shown a diagrammatic view of a fluid circuit. Shown at 301 is a cylindrical body or cylinder of an actuator, at 302 a piston adapted to slidingly move within the cylinder 301, and at 303 a piston rod. The interior of the cylinder 301 is divided by the piston 302 into two chamber, i.e., a rod-side chamber 305 and a head-side chamber 304. A fluid circuit is established, including a fluid path 308 leading from the rod-side chamber 305 via flow-rate-control, pressure-regulating valve assembly 310, and a flow-direction change-over valve 306 to a pressure source, and another fluid path 307 leading from the head-side chamber 304 via a speed-control safety valve and quick-discharge valve assembly 309 and the flow-direction change-over valve 306 to the pressure source.

Figure 8:
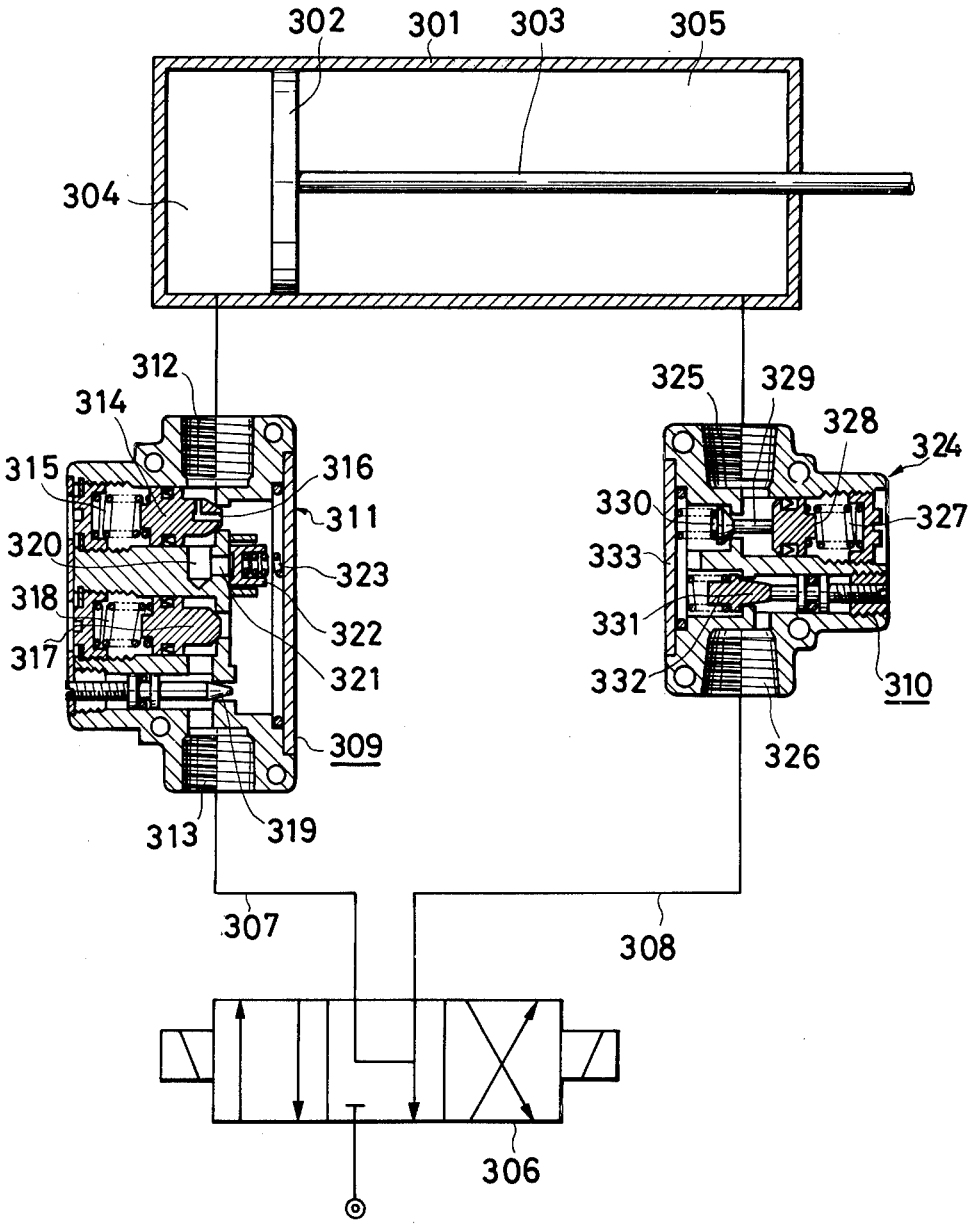
FIG. 8 is a diagram of a detailed fluid circuit of FIG. 7.

FIG. 8 illustrates the operation of the both valve assemblies 309 and 310.

Referring first to the speed-control-safety valve and quick-discharge valve assembly 309, ports 312, 313 are provided in a body 311 of the valve assembly 309. Provided adjacent to the port 312 communicated with the head-side chamber 304 is a piston valve 314 which is adapted to assume an open position, when a pressure in the head-side chamber 304 exceeds a given pressure level. The piston valve 314 is urged against its cooperative valve seat under the action of a spring 315 to close a fluid passage therebetween. However, even when it is a closed position, a fluid may flow through a throttle passage 316 defined in a head portion of the piston valve 314. Provided in side-by-side relation to the piston valve 314 on the side away from the port 312 is another piston valve 317 adapted to assume a closed position in cooperation with its valve seat under the action of another spring 318. The piston valve 317 is adapted to assume its open position, when a pressure through the port 313 communicated with the flow-direction change-over valve 306 exceeds a given pressure level. Provided in side-by-side relation to the piston valve 317 on the side close to the port 313 is a throttle valve 319 whose opening may be adjustable externally. Meanwhile, the throttle passage 316 may be modified into an opening-variable type. A cavity 320 serves as a cushion for a pressure fluid, when the fluid radially rushes from the head-side chamber 304 to hit the piston valve 314. A valve body 322 is adapted to close an opening 321 of the cavity 320 with the aid of a spring 323, and normally maintains its closed position.

Referring to the flow-rate-control, pressure-regulating valve assembly 310, there are provided ports 325, 326 in its body 324. Provided adjacent to the port 325 communicated with the rod-side chamber 305 is a pressure regulating valve, which includes a valve body 330 secured to a piston 328 which is loaded to a predetermined load level by means of a spring 327 so as to maintain the valve body 330 in its open position. Provided in series with the pressure regulating valve but in side-by-side relation thereto on the side of the port 326 communicated with the flow-direction change-over valve 306 is a flow rate control valve or throttle valve 331 including a valve body 332 and a stem abutting the valve body 332. The valve body 332 on the other hand is urged by a spring 333 in the direction to close a fluid passage in cooperation with its valve seat. A clearance between a valve body 332 and its cooperating valve seat is dependent on the position of the stem and maintained at a predetermined value. When a fluid pressure is applied from the port 326, the valve body 332 is forced back so as to further widen the clearance between the valve body 332 and its valve seat.

In operation, when a pressure fluid is introduced via the fluid passage 307 into the head-side chamber, a pressure fluid first opens the piston valve 317 and is then fed through the throttle passage 316 in the piston valve 314 into the head-side chamber 304, thereby displacing the piston 302. Thus, work is taken out through the piston rod 303. In this case, when a pressure in the head-side chamber 304 is built up and as a result the piston valve 314 is forced to its open position, then a large amount of fluid may rush into the chamber 304, thereby quickly displacing the piston 302. On the other hand, a fluid is returned or discharged from the rod-side-side chamber 305 through the flow-rate-control, pressure-regulating valve assembly 310 to the flow-direction change-over valve 306 and eventually to the pressure source. In this case, a fluid passes through a clearance between the valve body 330 and its cooperating valve seat and then through the flow-rate-control valve or throttle valve 331 into the flow-direction change-over valve 306 and eventually to the pressure source, with the flow rate being controlled by the valve 331.

Conversely, when a pressure fluid is fed into the rod-side chamber 305 for a return stroke of the piston 302, a pressure fluid opens the valve 331 against the action of the spring 333 and is fed through a clearance defined between the valve body 330 and its cooperating valve seat, which clearance is dependent on a load applied by the spring 327, into the rod-side chamber 305 in the cylinder. This displaces the piston 302, so that a fluid in the rod-side chamber 304 is discharged or returned by opening the piston valve 314 and going through a clearance provided by the throttle valve 319 into the flow-direction change-over valve 306 and eventually to the pressure source. In this case, as well, when a pressure of a level exceeding a given level is applied to the flow-rate-control, pressure-regulating valve 319, then the valve body 330 is urged against its cooperating valve seat to close a fluid passage. In other words, the pressure required for a return stroke of a piston may be reduced to a desired level, thus saving energy required therefor. In addition, an advancing stroke of a piston may be accelerated according to the piston valve 314 which is adapted to be opened widely, when a pressure in the head-side chamber 304 is built up to a given pressure level, and yet a safe speed may be maintained by means of the throttle valve 319 and piston valve 217. Still furthermore, the fluid circuit in this embodiment may avoid the shortcomings experienced with a meter-in control of a speed controller.

Figure 9:
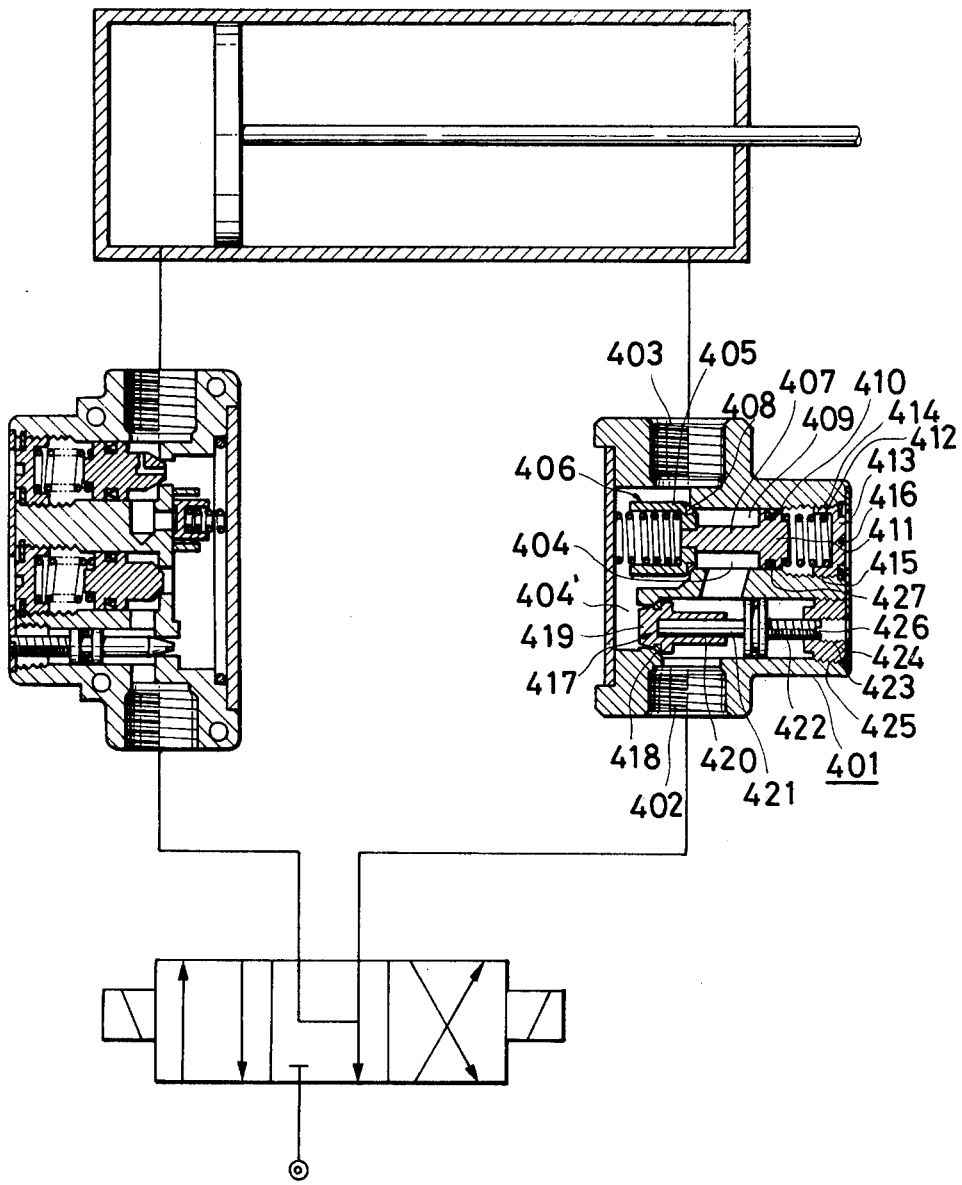
FIG. 9 is a diagram of a modification of a fluid circuit of FIG. 8.

FIG. 9 is a diagram of modification of the fluid circuit of FIGS. 7 and 8. In this embodiment of the invention, a flow rate control, pressure regulating valve assembly 401, is the same in construction as that shown in FIG. 5, while the remaining parts of the circuit in FIG. 9 are the same as the fluid circuit of FIG. 8. Thus, like parts in the valve assembly 401 are designated like reference numerals of the valve assembly 201 of FIG. 5, with the first figure in each reference numeral being changed from '2' to '4'. The flow rate control pressure regulating valve assembly 201, in FIG. 5 corresponds to the assembly 401 in FIG. 9. The valve assembly 401, as has been described with reference to FIG. 5, provides two parallel flow passages as shown at 404 and 404', in contrast to a series flow passage in the valve assembly 310 in FIG. 8.

In operation, when a primary-side pressure is applied through the inlet 402 into the body 401 of the assembly, then a fluid may be directed through a clearance between the valve body 405 and the valve seat 408, as well as past the valve body 419, as far as the pressure of a fluid is lower than a given set pressure lever. When the pressure exceeds the aforesaid given level, then the valve body 405 is forced against the valve seat due to a pressure acting on the piston 411.

Thus, on return stroke of a piston in an actuator, a pressure to be applied to the rod-side chamber may be reduced a desired level.

It will be understood that the above description is merely illustrative of preferred embodiments of the invention. Additional modifications and improvements utilizing the discoveries of the present invention can be readily anticipated by those skilled in the art from the present disclosure, and such modifications and improvements may fairly be presumed to be within the scope and purview of the invention as defined by the claims that follow.

What is claimed is:

1. A fluid circuit comprising:

an actuator having a piston-head-side chamber and a piston-rod-side chamber and a first piston separating said chambers;

a flow-rate-control, pressure-regulating valve assembly having an inlet port and an outlet port;

a flow-direction change-over valve connected to the inlet port of said flow-rate control, pressure-regulating valve assembly; and a pressure source connected to said flow-direction change-over valve;

said piston-rod-side chamber being connected to the outlet port of said flow-rate-control, pressure-regulating valve assembly and from the inlet port thereof to said flow-direction change-over valve and through said change-over valve to said pressure source, thereby establishing a first fluid path for a return stroke of said first piston, and a second fluid path connecting said piston-head-side chamber in bypassing relationship around said flow-rate-control pressure regulating valve assembly to said flow-direction change-over valve and therethrough to said pressure source, thereby establishing said second fluid path for an advancing stroke of said first piston, said flow-rate-control, pressure-regulating valve assembly comprises: a fluid passage in said assembly leading from said inlet port via a pressure regulating valve and then a flow-rate control valve to said outlet port; said flow rate control valve having a valve body, a valve stem and a valve-stem-position adjustable portion, said valve body being spring loaded so as to be urged against the top of said valve stem, thereby restricting said fluid passage; said pressure regulating valve including a valve body spring-loaded in the direction to close said fluid passage, and a second piston which is spring-loaded so as to force said valve body in the direction to open said fluid passage through the medium of a rod confined between said valve body and said second piston, whereby said second piston permits said pressure regulating valve to maintan a predetermined pressure in a fluid flowing through said fluid passage, said pressure regulating valve further including a communicating hole allowing the introduction of a fluid from said fluid passage to said second piston, whereby when a pressure of a level exceeding a given pressure level is introduced into said fluid passage said second piston is displaced against the spring-loaded effect and hence said rod is pushed back by the spring-loading in said valve body, thereby closing flow through said fluid passage.

* * * * *